US005253150A

United States Patent [19]

Vanni

[11] Patent Number: 5,253,150

[45] Date of Patent: Oct. 12, 1993

[54] WARNING LIGHT

[76] Inventor: Robert R. Vanni, 701 Tuxedo Ave., Brooklyn Hts., Ohio 44131

[21] Appl. No.: 907,123

[22] Filed: Jul. 1, 1992

[51] Int. Cl.[5] ..... F21L 11/00

[52] U.S. Cl. ..... 362/183; 362/84; 362/215; 362/260; 362/802; 340/908

[58] Field of Search ..... 313/501, 506; 340/908, 340/908.1; 362/34, 84, 152, 183, 184, 215, 260, 339, 802

[56] References Cited

U.S. PATENT DOCUMENTS

| | | | |
|---|---|---|---|
| 2,798,147 | 7/1957 | Orsatti | 340/908 |
| 3,435,412 | 3/1969 | Bohrer, Sr. | 340/908 |
| 3,766,881 | 10/1973 | Ward | 116/63 P |
| 4,011,665 | 3/1977 | Port | 434/410 |
| 4,138,620 | 2/1979 | Dickson | 362/84 |
| 4,215,390 | 7/1980 | Brandt | 362/311 |
| 4,329,534 | 5/1982 | Hodgson et al. | 136/247 |
| 4,677,010 | 6/1987 | Selwyn | 428/40 |
| 4,767,966 | 8/1988 | Simopoulos et al. | 313/509 |
| 4,772,990 | 9/1988 | Linehan et al. | 362/183 |
| 4,841,278 | 6/1989 | Tezuka et al. | 340/908.1 |
| 4,884,017 | 11/1989 | Williams | 340/908.1 |
| 4,903,172 | 2/1990 | Schoniger et al. | 362/183 |
| 4,904,901 | 2/1990 | Simopoulos et al. | 313/509 |
| 5,036,249 | 7/1991 | Pike-Biegunski et al. | 313/509 |
| 5,067,063 | 11/1991 | Granneman et al. | 362/84 |
| 5,126,214 | 6/1992 | Tokailin et al. | 313/506 |

*Primary Examiner*—Albert J. Makay
*Assistant Examiner*—Alan B. Cariaso

[57] ABSTRACT

A warning light (100) is provided that includes a base member (4) having at least one electroluminescent panel (14) mounted thereon that is enclosed by an upper housing (2) secured to base member (4) and of which at least a portion comprises a lens member preferably in the form of at least one panel section (8) that includes fluorescent material operative to fluoresce upon exposure to light incident thereupon emitted by electroluminescent panel (14). Warning light (100) is preferably powered by a rechargeable battery (20) that is charged by at least one solar cell (28) mounted on upper housing (2) in a manner operative to enable solar energy to be incident thereupon.

3 Claims, 1 Drawing Sheet

WARNING LIGHT

INTRODUCTION

This invention relates generally to a warning light operative to alert a viewer to a condition such as the location of a vehicle or a marine craft at night or as to a hazardous traffic or road condition and the like and more particularly to a warning light that is operative to remain illuminable for long periods of time by employing at least one electroluminescent panel as its light source whose effectiveness is enhanced by employment of a lens member containing fluorescent material that fluoresces upon exposure to light emitted by the electroluminescent panel incident thereupon.

BACKGROUND OF THE INVENTION

The ability of battery powered warning lights to operate for long periods of time has heretofore been somewhat diminished by the fact that such warning lights have used conventional incandescent lights or flash tubes having electrical power requirement that, under continuous operating conditions, may drain the battery within a matter of hours which is expensive and time consuming and particularly so when a large number of such warning lights are employed to designate driving lanes along a length of road under repair.

In view of the foregoing, there has long been a need to extend the operating life of battery powered warning lights without sacrificing the level of illumination provided thereby.

The present invention addresses the problem of extending operating life of battery powered warning lights by combining a low power draw electroluminescent light panel as the light source that in turn is enclosed by a lens containing fluorescent material that fluoresces to enhance the brightness of the electroluminescent panel light incident thereupon.

Electroluminescent lighting panels have been known for many years. Such panels are made by laminating films together and can be in the order of 20 mils or less in thickness and can range from being somewhat rigid to flexible depending upon the materials selected. The panels generally comprise a phosphorescent layer and a dielectric layer sandwiched between a transparent electrode layer (commonly made with indium oxide) and a more conventional electrode layer such as made from metalized plastic and all of which is commonly enclosed by a transparent film providing a moisture barrier about the panel. Electrodes are fixed to the electrode layers (commonly by a suitable adhesive) and a lower power alternating electrical fluid imposed between the electrodes causes the excited phosphor particles to glow to provide low power draw lighting that heretofore has been limited in use to instrument panel lighting in vehicles and the like.

Greater detail in the design of electroluminescent panels can be found for example in U.S. Pat. Nos. 4,767,966; 4,904,901 and 5,036,249, the disclosures of which are incorporated herein by reference.

The use of fluorescent materials in reflective marker and other signs and in lighting members utilizing conventional incandescent light bulbs or zenon type gas-filled tubing is also known and is described for example in U.S. Pat. Nos. 3,766,881; 4,677,010; 4,011,665 and 4,215,390, the disclosures of which are incorporated herein by reference.

No one heretofore had thought to combine the low power draw glow provided by electroluminescent panel lighting with a lens containing a fluorescent material operative to fluoresce and enhance the brightness of the light sufficiently to enable effective operation as a warning light over long periods of time.

SUMMARY OF THE INVENTION

Accordingly, it is an object of this invention to provide a warning light having low electrical power requirements.

It is another object of this invention to provide a battery powered warning light that is capable of operating continuously over long periods of time.

It is still another object of this invention to provide a warning light that effectively magnifies the brightness of light produced by an electroluminescent panel.

It is yet another object of this invention to provide a warning light that uses a lens member containing fluorescent material for enhancing the brightness of light provided by a low power draw electroluminescent panel.

DESCRIPTION OF SOME PREFERRED EMBODIMENTS

Figure 1:
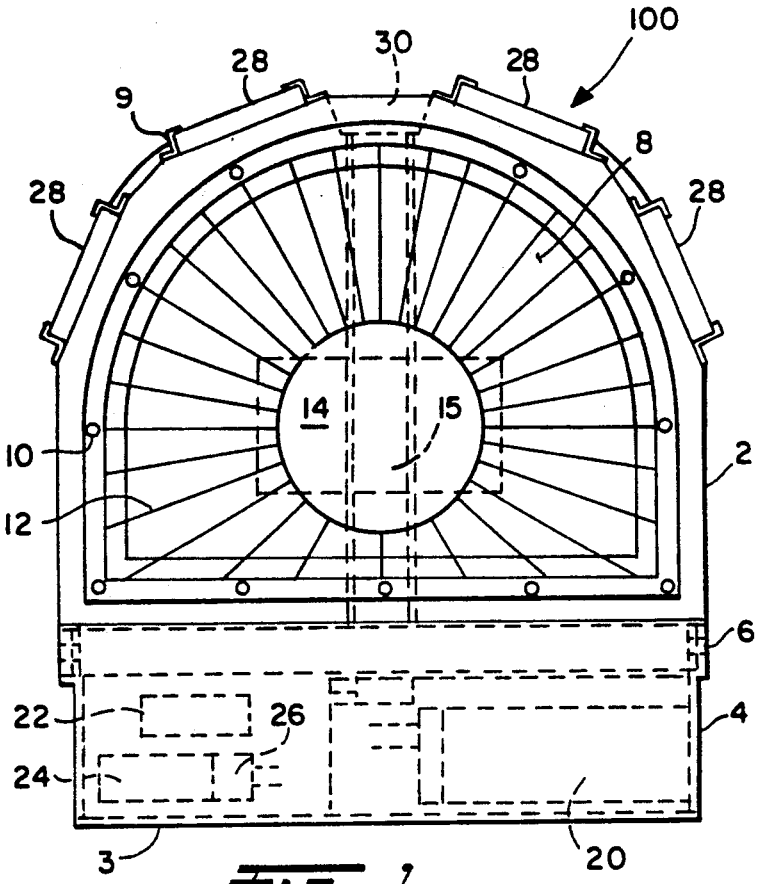
FIG. 1 is a front elevation view of a preferred embodiment of the warning light of the invention referenced by numeral 100.
Figure 2:
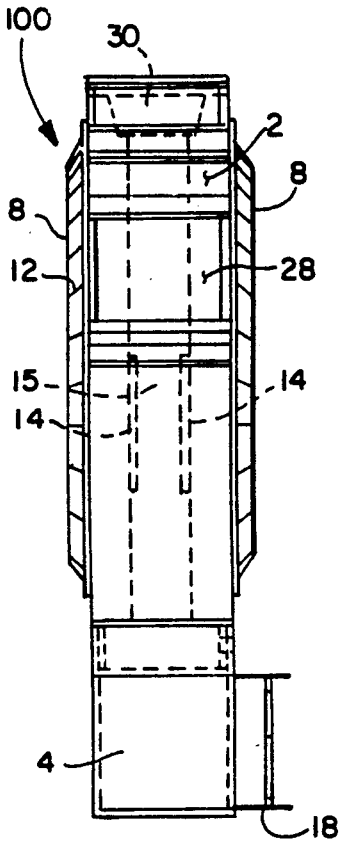
FIG. 2 is a right side elevation view of warning light 100 of FIG. 1.

Warning lights 100 of FIGS. 1 and 2 has a base member 4 to which is secured to an upper housing member 2 preferably by means of releasable fasteners such as threaded screws referenced by numeral 6. The bottom of upper housing 2 preferably overlaps the top edge of base member 4 as shown in FIGS. 1 and 2 to prevent water from entering. A suitable moisture seal (not shown) may be included at the juncture between base member 4 and upper housing 2 for even greater protection against water entering base member 4.

Base member 4 preferably includes one or more drain or weep holes such as referenced by numeral 3 in FIG. 1 to enable any water or condensate to drain from base member 4.

Base member 4 and upper housing 2 are preferably made such as by molding from suitable plastic materials with base member 4 preferably being made from a suitable opaque or translucent material. At least a portion of upper housing 2 comprises a lens member preferably in the form of a pair of panel sections 8 respectively disposed on opposite sides of upper housing 2 that are made from suitable translucent and more preferably transparent plastic materials hereinafter described.

Warning light 100 need not be made completely from plastic materials if so desired for variations in the combined use of metal and plastic may be employed such as where base member 4 is made from a suitable metal and upper housing 2 is made from a translucent or transparent plastic or where portions of upper housing 2 are made of metal having openings for containing one or more lens members hereinafter described in greater detail and having spaced windows or depressions for positioning solar cells referenced by numeral 28 in the FIGURES when such are employed in the warning light of the invention.

Although other plastic materials may be used, polycarbonates and acrylics are especially preferred plastics of which suitable polycarbonates include those commercially available from General Electric Company under the LEXAN trademark and under the Trademark MERLON from the Mobay Chemical Company. Suitable acrylic resins include those commercially available under the trademarks LUCITE from the Du-Pont Company and PLEXIGLAS from Rohm & Haas.

Although upper housing 2 may comprise the lens member in its entirety by being made as a singular piece such as by molding, vacuum forming or injection molding a translucent or transparent plastic that includes an effective amount of fluorescent material dispersed uniformly throughout as hereinafter described, it preferably includes at least one lens member and more preferably a pair of lens members in the form of the previously described panel sections disposed on opposite sides of upper housing 2 that are referenced by numeral 8 in FIGS. 1 and 2 and to which an effective amount of one or more fluorescent materials has been incorporated and each of which is illuminable by one of a pair of the electroluminescent panels mounted on opposite sides of a pedestal or post 15 that extends upwardly from base member 4 into upper housing 2 so that the light is emitted respectively therefrom towards panel sections 8 as hereinafter described.

Although panel section(s) 8 may be formed integrally with the rest of upper housing 2 or be separate therefrom and fixedly secured thereto by adhesion or heat fusion or the like, they are preferably releasably secured to upper housing 2 by means of threaded fasteners such as referenced by numeral 10 in FIG. 1.

The lens member (such as panel(s) 8) preferably includes at least one score mark that is operative to enhance the brightness of reflected exterior light incident thereupon such as for example provided by a vehicle's headlight where the lens member may comprise the entirety of upper housing 2 as previously described.

The score mark is preferably in the form of a plurality of score lines referenced by numeral 12 that extend radially outwardly away from the center of at least one and preferably both of lens members 8 shown in FIGS. 1 and 2 and are in circumferential spaced relationship to each other.

As used herein, the term "score marks" or "score lines" are marks including lens that may be etched, cut, machined, or molded into the surface of lens member 8 in a manner operative to achieve enhanced reflection of exterior light incident thereupon.

Base member 4 likewise may be formed from plastic by molding, vacuum forming, or injection molding and may further include a mounting bracket for securing it to an object such as a road marker barrel or ship most of which an exemplary example is referenced by numeral 18 in FIG. 2.

As set forth in previously described U.S. Pat. No. 4,215,390, the term "fluorescent" is used in this specification and claims include not only those materials that luminesce when excited by light radiation, but also those that may be considered phosphorescent, i.e., which continue to glow after the excitation has ceased. Such fluorescent materials are generally either solid or liquid inorganic or organic materials that are able to convert absorbed radiation from light to its preferred wavelength, e.g., red, yellow, etc. Representative materials include the organic fluorescent pigments generally known as aminoketones and thioindigos. Mohawk yellow D-299, available from Dayglo Corp. of Clevaland, Ohio, is an aminoketone and Hostasol Red-5B, available from American Hoescht Corp. of Coventry, R.I., is a thioindigo. Additional fluorescent materials that are available are in yellow, blue, green, and red and are in numerous U.S. patents including U.S. Pat. No. 3,276,216 and U.S. Pat. No. 3,928,226 the disclosures of which are included herein by reference.

The fluorescent material is added to the plastic in an amount ranging preferably from about 0.01% to about 1.0% by weight of the plastic. The exact amount to be employed, of course, will vary to some extent with the fluorescent material and the plastic employed and the results desired.

In the preferred practice of the invention, the fluorescent material is added to the plastic resin with mixing to form a uniform mixture and the lens member is then formed by injection molding employing conventional times, pressures, temperatures and equipment.

A suitable ultra-violet screener is preferably incorporated along with the fluorescent material with the plastic from which the lens member is made to prevent exterior ultra-violet rays such as associated with sun light from deteriorating the fluorescent material.

Figure 3:
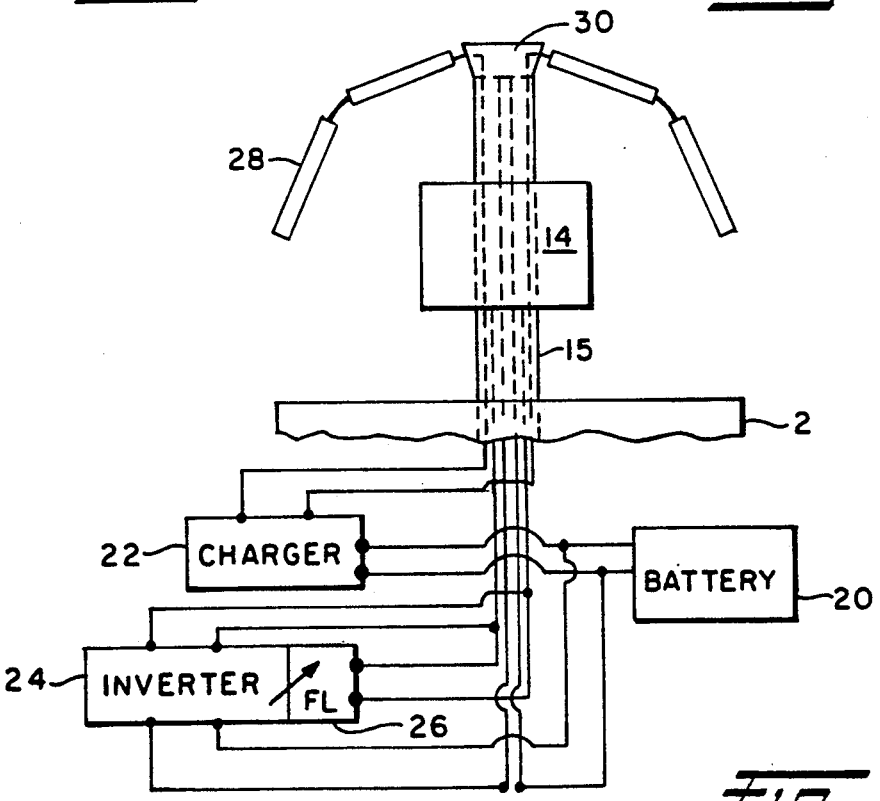
FIG. 3 is a schematic block diagram of one embodiment of the electrical circuitry associated with warning light 100 of FIGS. 1 and 2.

A preferred embodiment of the electrical power source and associated circuitry for powering electroluminescent panel(s) 14 is shown in FIG. 1 and is described in greater detail with respect to FIG. 3.

Warning light 100 utilizes a direct current battery 20 contained in base member 4 as its power source. Battery 20 is preferably either a 6 or 12 volt DC battery preferably of the nickel-cadmium sided type.

The DC power is delivered to an inverter referenced by numeral 24 that is preferably operative to alternately reverse the battery voltage polarity to provide from about 50 to about 100 volts AC at about 500 Hz which is delivered to electroluminescent panel(s) 14 and provides the alternating electrical field operative to cause the phosphor particles to glow as previously described.

Electroluminescent panel(s) 14 emit light (glow) in response to a command signal that is produced for example by a light sensor such as a photoelectric cell referenced by numeral 30 that closes the circuit to enable the alternating electrical field to be delivered to Electroluminescent panel(s) 14 when the exterior light incident thereupon falls below a pre-established minimum value and ceases to provide the command signal when the exterior light incident thereupon rises above the pre-established minimum value. Electroluminescent panels 14 are mounted on a pedestal or post 15 that extends upwardly from base member 4 into upper housing 2 and is preferably hollow such as a tube to provide a wire chasc for containing the electrical wires connecting solar cells 28 and light sensor 30 to the electrical circuitry contained in base member 4.

The warning light of the invention also preferably includes a flasher function such as represented by the letters FL and the numeral 26 in FIG. 3 and which is an interrupter operable to pulse the delivery of the alternating electric field to electroluminescent panel(s) 14. The warning light of the invention preferably further includes a switch such as represented by the arrow between inverter 24 and flasher or interrupter 26 that enables one to select either a steady light or a flashing light.

Previously described battery 20 is preferably a rechargeable battery and the warning light of the invention preferably includes at least one and more typically from about 4–6 solar cells referenced in the FIGURES by numeral 28 such as described in U.S. Pat. No. 4,329,534 and the disclosure of which is incorporated herein by reference. Solar cells 28 are preferably connected together in series with a solid state charging circuit or member referenced by numeral 22. Solar cells 28 are operative to charge battery 20 with electrical energy converted from solar energy incident thereupon and which are therefore preferably mounted about the periphery of upper housing 2 and held by suitable means such as by clips 9 in spaced-apart depressions in the manner shown in FIG. 1. Solar cells 28 may also be secured by a suitable means to the inner side of the periphery of upper housing provided they are able to receive light energy necessary for their operation.

The warning light of the invention is able to operate for long periods of time since the total current draw for two of the electroluminescent panels is characteristically only from about 1.0 to about 2.0 milliamps, that when combined with the addition of fluorescent material to the lens member, enables the warning light of the invention to provide enhanced visibility in various ambient weather and light conditions including the ability to penetrate smoke, haze and fog.

While the foregoing description has been made with particular emphasis on a preferred embodiment thereof, it will be understood by those skilled in the art that numerous modifications may be made without departing from the spirit and scope of the present invention as defined by the following claims.

What is claimed is:

1. A warning light comprising:

a base member having a pair of electroluminescent panels mounted thereon such that, upon illumination, light is emitted in opposite directions respectively therefrom, a rechargeable battery power source and associated circuitry contained within the base member and connected to the electroluminescent panels in a manner operative to effect the illumination thereof in response to a command signal, a light sensor mounted on the light and operative to provide the command signal when the energy of exterior light sensed thereby falls below a preselected minimum value and ceases to provide said signal when the energy of exterior light sensed thereby rises above the preselected minimum value, an inverter included in the circuitry and operative to alternately reverse the battery potential polarity to provide an alternating electrical field effective to illuminate the electroluminescent panels, an interrupter included in the circuitry and operative to interrupt illumination of the electroluminescent panels to create a flashing effect, a charging circuit and at least one solar cell connected to the battery thereby, said solar cell operative to receive and convert solar energy incident thereupon to electrical energy and to store and charge the battery through the charging circuit therewith, and an upper housing positioned about the electroluminescent panels and secured to the base member, said upper housing having a pair of panel sections respectively disposed on opposite sides thereof and respectively illuminable by one of the electroluminescent panels, said panel sections each containing a fluorescent material that fluoresces upon exposure to light emitted by the respective electroluminescent panels incident thereupon, and said panel sections each including at least one score mark in the surface thereof operative to enhance brightness of incident exterior light reflected thereby.

2. The light of claim 1 wherein the interrupter is a selectively operative interrupter.

3. The light of claim 1 wherein the panel sections each have a plurality of the score marks in the form of score lines that respectively extend radially outwardly away from the respective centers thereof in circumferential spaced relationship to each other.

* * * * *